United States Patent [19]

Vink

[11] Patent Number: 4,746,837

[45] Date of Patent: May 24, 1988

[54] COLOR DISPLAY TUBE DEFLECTION UNIT WHICH CORRECTS LEFT-RIGHT RASTER DISTORTION

[75] Inventor: Nicolaas G. Vink, Eindhoven, Netherlands

[73] Assignee: U.S. Philips Corp., New York, N.Y.

[21] Appl. No.: 945,418

[22] Filed: Dec. 22, 1986

[30] Foreign Application Priority Data

Dec. 23, 1985 [NL] Netherlands ..... 8503544

[51] Int. Cl.[4] ..... H01F 3/12; H01J 29/76

[52] U.S. Cl. ..... 313/431; 313/440; 335/211; 335/213

[58] Field of Search ..... 313/440, 431; 335/210, 335/212, 213, 211

[56] References Cited

U.S. PATENT DOCUMENTS

| | | | |
|---|---|---|---|
| 4,257,023 | 3/1981 | Kamijo | 335/210 X |
| 4,429,293 | 1/1984 | McGlashan | 335/211 |
| 4,433,268 | 2/1984 | Arisato | 313/440 |
| 4,556,857 | 12/1985 | Logan | 313/440 X |
| 4,636,684 | 1/1987 | Yokota et al. | 313/440 X |
| 4,668,929 | 5/1987 | Bernhard | 335/211 |

*Primary Examiner*—Palmer C. DeMeo

*Attorney, Agent, or Firm*—Thomas A. Briody; Jack Oisher

[57] ABSTRACT

A color display tube deflection unit having an annular magnetizable core of tapered cylindrical shape and a raster distortion correction device comprising four pole shoes positioned at the corners of a rectangle adjacent the end of the core facing the display screen, the pole shoes respectively being near respective ends of a pair of vertical deflection coils. The four pole shoes are connected in pairs by respective bridging flux collector elements of soft magnetic material. The flux collector elements divert magnetic flux from the core which otherwise would not have emerged from the core, and such flux is conveyed to the pole shoes so as to cause the vertical deflection field to become pincushion-shaped adjacent the display screen.

4 Claims, 3 Drawing Sheets

COLOR DISPLAY TUBE DEFLECTION UNIT WHICH CORRECTS LEFT-RIGHT RASTER DISTORTION

BACKGROUND OF THE INVENTION

1. Field of the Invention

The invention relates to an in-line colour display tube a deflection unit having a magnetisable core whose diameter increases towards the screen of the display tube, said core surrounding a pair of line deflection coils, a pair of vertical deflection coils which are coaxial with the line deflection coils, and a raster correction device having four pole shoes positioned at the diagonals of the picture screen and extending along and parallel to the funnel portion of the display tube, said pole shoes receiving flux from flux collecting members, whereby a pincushion distributed vertical deflection field is formed between said pole shoes.

2. Description of the Related Art

A deflection device of this type is known from U.S. Pat. No. 4,556,857.

Colour television receivers typically comprise a so-called self-convergent picture display system including a display tube whose electron gun system produces three electron beams located in one plane, and a deflection device causing the electron beams of the display tube to converge on the display screen without circuits for dynamic convergence correction being required for that purpose. To achieve this, line deflection coils of the deflection device have such a distribution of turns that the generated deflection fields in the deflection region of the electron beams are inhomogeneous. It is known that for achieving an efficient convergence the line deflection coils should generate a deflection field which (viewed in planes at right angles to the longitudinal axis of the display tube) is pincushion-shaped, whereas the vertical deflection coils should generate a barrel-shaped deflection field. Furthermore it is known that local variations in inhomogeneity of the deflection field may contribute to the correction of certain forms of raster distortion.

A local pincushion-shape of the vertical deflection field near the end of the deflection device facing the display screen contributes to the correction of what is commonly referred to as the east-west raster error, which means that the left and right side of the raster with respect to the corners appear to be bent inwards. This pincushion-shaped field may be produced by choosing the distribution of turns on the vertical deflection coils in a particular manner. However, the vertical deflection coils should generate a barrel-shaped field as a whole in order that the convergence requirement is satisfied. It is therefore difficult to manufacture vertical deflection coils satisfying both the convergence requirement and the requirement of a sufficiently small east-west raster distortion.

The above cited U.S.-Patent describes a raster correction device comprising two flux collector members of a magnetisable material extending on the outer side of the vertical deflection coils in the stray field existing there. The flux collector members conform to the coils and are generally coextensive with the tube axis. The end of each flux collector member is provided with a limb pointing towards the display screen, said limbs constituting field shaper members. The flux collector members collect a part of the stray flux from the vertical deflection coils and convey it to the field shapers thus realizing a redistribution of the stray flux. Thereby a pincushion-shaped field which provides a correction of the east-west raster distortion is formed between the field shapers.

In certain cases the above described collecting and redistributioning of the existing stray flux and the formation of a pincushion-shaped field may not be efficient enough.

SUMMARY OF THE INVENTION

The invention has for its object to provide a deflection device comprising a raster correction device which has a more effective operation as compared with the construction described in the Patent cited above.

To this end a deflection device of the type described, according to the invention is characterized in that the flux collector members are disposed to confront at least a portion of the screen-sided end face of the core, considered in a radial direction.

This means that the collector members are disposed not only to collect existing stray flux lines emerging from the end face of the core, but also to divert additional magnetic flux from the core which would not emerge from the core without these members. In other words: it is a feature of the invention that a correction field is created which is derived from the magnetisable core by using the magnetic potential on the edge of the core to divert extra field lines from the core. As extra magnetic flux is diverted from the core, the efficiency of the deflection device according to the invention is better than that of the prior deflection devices.

Since the invention diverts flux from the core, it is applicable both to deflection devices having saddle-type vertical deflection coils and deflection devices having toroidal-type vertical deflection coils. The known construction, which uses the stray vertical of the field deflection coils, is only applicable to deflection devices having toroidal-type vertical deflection coils.

The collector members may be designed in different manners within the scope of the invention, dependent on the amount of the raster correction which is desired. A substantial effect on the raster correction is found to be obtained with an embodiment which is characterized in that the four pole shoes are connected pairwise by means of respective bridging flux collector members extending over an arc between the pole shoes of each pair, said bridging collector members lying in a plane substantially parallel to the screen-sided end face of the core.

An embodiment of the deflection device according to the invention is characterized in that the bridging collector members are constituted by two flat C-shaped parts the ends of which are each provided with lugs extending transversely to the plane of the parts, the ends of said lugs being bent outwards and the outwardly bent ends of the lugs constituting the said pole shoes.

Since the flux collector members of the known raster correction device extend generally coextensively with the longitudinal tube axis, it is difficult to mount them (in an automated process). The preferred collector members of the deflection device according to the invention are flat and lie in a plane substantially parallel to the screen-sided end face of the core and can therefore easily be mounted (in an automated process) on a flange which forms part of the coil support.

More particularly this provides the possibility of integrating the raster correction device according to the invention with a coil support of synthetic material.

To this end a further embodiment of the deflection device according to the invention is characterized in that the core and the pairs of deflection coils are supported by a synthetic material support and that the raster correction device, at least as far as the bridging elements are concerned, is incorporated with the synthetic material support.

BRIEF DESCRIPTION OF THE DRAWINGS

An embodiment of the invention will be explained and described in greater detail, by way of example, with reference to accompanying drawings, in which

FIG. 1 shows a prior art picture display device. It comprises a picture tube 10 having a neck 11 which houses an electron gun, a cone 12 and a picture screen. A deflection unit 13 is mounted on the display tube 10 by means of a clamping band 18. Deflection unit 13 comprises a pair of vertical deflection coils 14*a*, 14*b* each being toroidally wound on respective halves of a core 15 of a magnetisable material. Furthermore deflection unit 13 comprises a pair of line deflection coils 16*a*, 16*b* placed on the inside of the core 5, which coils are visible in the FIG. 2. A synthetic material support 17 separates the line and vertical deflection coils from each other and functions as a supporting and aligning element for the coils and the core. Support 17 is provided with a structure 28 with peripheral grooves, said structure 28 providing electrical connections for the coils. A raster correction device is present comprising magnetic flux collector members 19, 20 and field shaper members 36, 37, 40, 41. The flux collector members 19, 20 conform closely to the vertical deflection coils 14*a*, 14*b* and are generally coextensive with the tube axis 2. They are located on opposite sides of the yoke assembly and extend from one coil to the other of the vertical deflection coil pair. Flux collector members 19, 20 are of a highly permeable magnetic material in order to constitute a low-reluctance path for the stray field present on the outside of the vertical deflection coils. The magnetic stray flux which is collected is further guided by means of elements 23 and 24. Field shapers 36 and 37 extend along and are parallel to cone 12 and are formed on the ends of the elements 23 and 24. Field shapers 36, 37, 40 and 41 are positioned at the diagonals of the rectangular picture screen and ensure that flux passes from field shaper 36 to field shaper 40 and from field shaper 37 to field shaper 41. Thereby the collected stray flux is redirected to correct pincushion-distorsion.

A more effective embodiment of a raster correction device is diagrammatically shown in FIGS. 3 and 4. FIGS. 3 and 4 show a display tube 42 having a neck 43 and a cone 44. A deflection unit 45 is mounted on display tube 42. Deflection unit 45 comprises a pair of vertical deflection coils 46*a*, 46*b* toroidally wound onto a magnetisable core 47. Furthermore deflection unit 45 comprises two C-shaped permeable flux collecting elements 48 and 49, which are placed in such a manner that they divert part of the magnetic flux from the core 47. The diverted flux is guided by the flux collecting elements 48, 49 to pole shoes 50, 51, 52, 53. The flux passing between the pole shoes 50 and 52 and 51 and 53 constitutes a pincushion-shaped deflection field which makes a highly effective raster correction possible.

The flat shape of the flux collecting elements 48 and 49 makes it possible to mount them in a simple manner, namely by integrating them with a support 54 of synthetic material supporting the deflection coils and the core. Line deflection coils 55*a*, 55*b* are mounted against the inner face of the support 54 (FIG. 4). As shown in FIGS. 3, 4, and 5 core 47 consists of two halves between which a seam 56 is formed. The preferred areas for diverting magnetic flux (i.e., the areas where the magnetic potential is a maximum) from core 47 are located on both sides of seam 56, said seam 56 coinciding with the plane of symmetry of the line deflection coils 55*a*, 55*b*. In this connection an advantageous embodiment of the invention is characterized in that each collector member 48, 49 is provided with respective tabs 57, 58 and 59, 60 which project from the radially inner (or outer) edge of the respective collector member towards the core 47 and lie on both sides of the plane of symmetry of the line coils 55*a*, 55*b*. Depending on whether the tabs project to the inner or the outer side of the face of the core, they can collect flux from the primary or the secondary (or stray) vertical deflection field. They form very effective means for adjusting the amplitude of the correction field. Tab lengths are e.g. from 2 to 6 mm. If desired collector members 48, 49 may be split along the plane of symmetry of the line deflection coils 55*a*, 55*b*. This does not affect their operation. As is shown diagrammatically in FIG. 6 collector member 19 of the prior art raster correction device is so disposed as to intercept field lines on the outer side of the core 15. The position of collector member 19 is representative of the position of the other collector member 20. As is shown in FIG. 6, which represents the situation of FIG. 7 viewed in the direction of arrow VII, the magnetic flux collected by collector members 19, 20 (see FIGS. 1 and 2) is redirected by field shapers 36 and 40 so as to form a pincushion-shaped field deflection field.

FIG. 8 diagrammatically shows that the collector member 48 of the inventive raster correction device is disposed to confront at least a portion of the screen sided end face (=the large diameter end face) of the core 47. This arrangement is also shown in FIG. 5. The position of collector member 48 shown in FIG. 8 is representative of the position of the other collector member 49. The effect of the inventive arrangement is shown in FIG. 9, which represents the situation of FIG. 8 viewed in the direction of arrow IX. As the flux collector members 48, 49 divert magnetic flux from core 47 which without the members would not contribute to the vertical deflection field since it would not even emerge from the core, a strong pincushion-shaped field deflection field is produced. The amount of flux collected by the collector members 48, 49 (=the amplitude of the correction field) can accurately be selected by adjusting the spacing S between the collector members 48, 49—which are in a plane substantially parallel to the large diameter end face of core 47—and the said end face. In a practical application a spacing S which is of 1 to 2 mm appeared to provide good results. This is much easier than changing the dimensions of the collector members, which would be necessary in the case of the prior art raster correction device.

Figure 1:
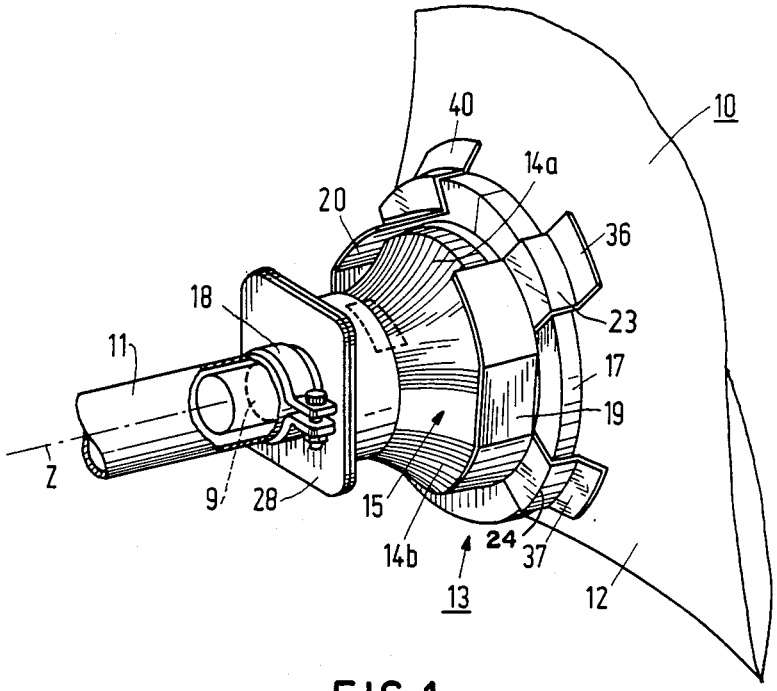
FIG. 1 PRIOR ART
FIG. 1 is a perspective view of a picture display tube with a deflection unit including a known raster correction device.
Figure 2:
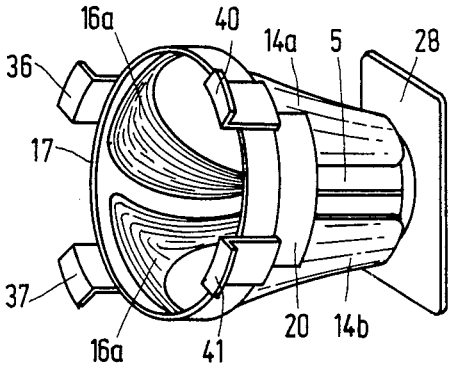
FIG. 2 PRIOR ART
FIG. 2 is a perspective view of the deflection unit of the picture display tube of FIG. 1.
Figure 3:
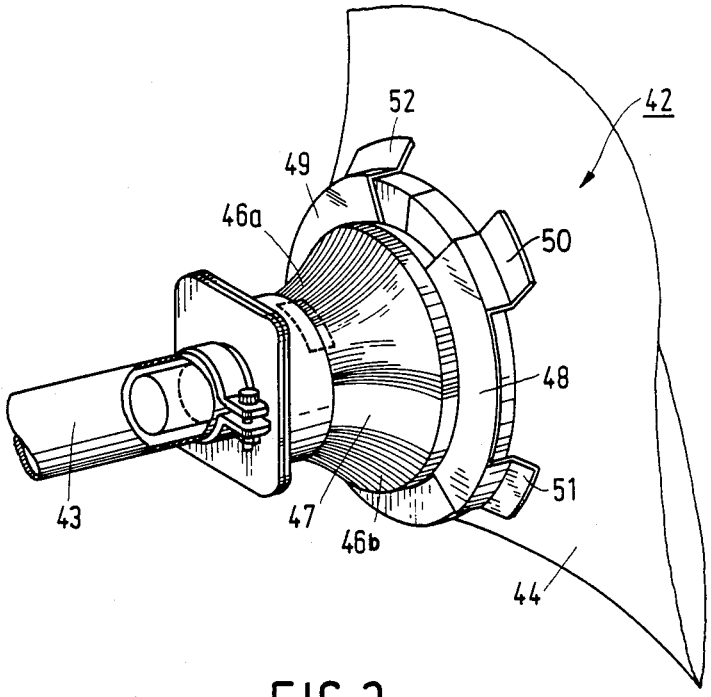
FIG. 3 is a perspective view of a picture display tube with a deflection unit according to the invention.
Figure 4:
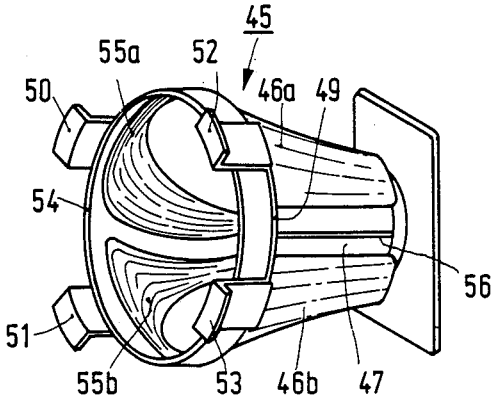
FIG. 4 is a perspective view of the deflection unit of the picture display tube of FIG. 3.
Figure 5:
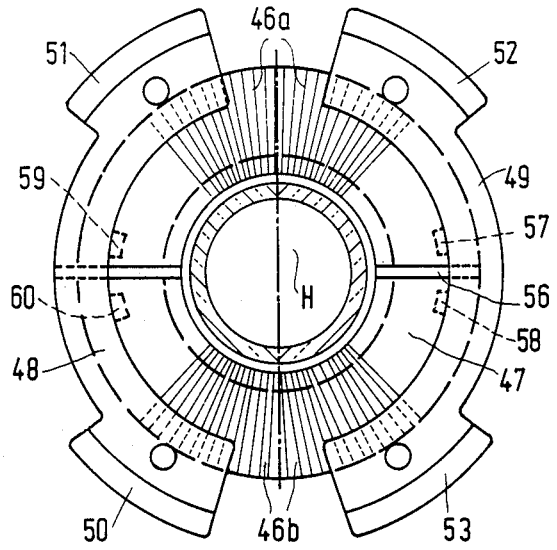
FIG. 5 shows a front elevation of the relative positioning of the flux collector members of the deflection unit of FIG. 4 with respect to the core.
Figure 6:
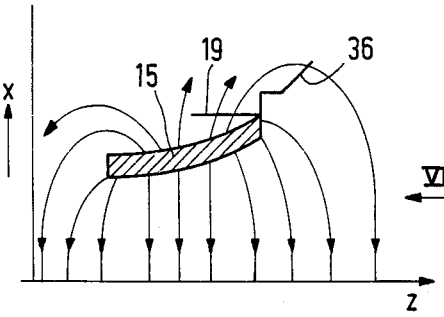
FIG.6 PRIOR ART
FIGS. 6 and 7 show a diagrammatic representation of the distribution of the vertical deflection field in the case of the use of a prior art raster correction device.
Figure 7:
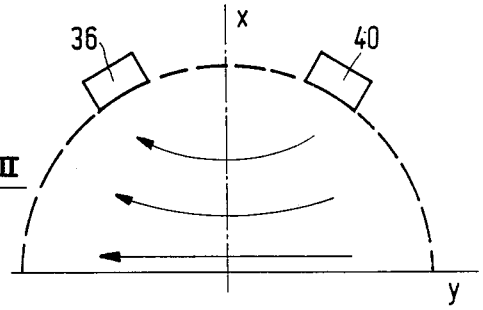
FIG.7 PRIOR ART
Figure 8:
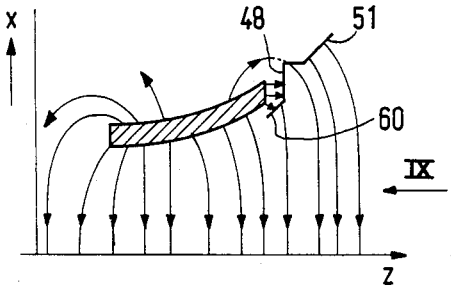
FIGS. 8 and 9 show a diagrammatic representation of the distribution of the vertical deflection field in the case of the use of a raster correction device according to the invention.
Figure 9:
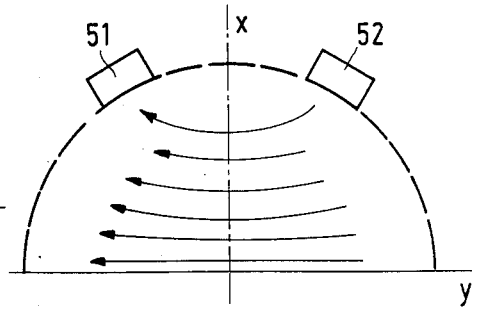

What is claimed is:

1. A deflection unit for a color display tube having an envelope comprising a neck portion, a funnel portion and a rectangular picture screen, said deflection unit comprising: a magnetizable annular core of tapered cylindrical shape which extends with increasing diameter towards the screen of the display tube, ending prior thereto, such end of said core having a planar annular face; a pair of line deflection coils positioned within said core; a pair of vertical deflection coils positioned on said core and which are coaxial with the line deflection coils; and a raster distortion correction device having four magnetic pole shoes respectively positioned at respective corners of a rectangle facing the picture screen and extending substantially parallel to the funnel portion of the display tube, said pole shoes being affixed to and receiving magnetic flux from a pair of flux collector members of magnetizable material, so that a pincushion-shaped distortion of the deflection field produced by the vertical deflection coils is formed between said pole shoes; characterized in that said flux collector members are substantially planar and are positioned facing and parallel to the planar end face of said core, at a predetermined spacing therefrom, so as to divert flux from said core to said pole shoes.

2. A deflection unit as claimed in claim 1, characterized in that the four pole shoes are connected pairwise by said pair of planar flux collector members, such flux collector members arcuately bridging between the pole shoes of each pair and lying in a plane parallel to the planar end face of said core.

3. A deflection unit as claimed in claim 2, characterized in that each of said flux collector members is constituted by a flat C-shaped part which at each end thereof has a lug extending transversely to the plane of such part, the end of each of said lugs being bent outwards and the so-outwardly bent ends of the lugs constituting the said pole shoes.

4. A deflection unit as claimed in claim 3, characterized in that said core and said pairs of deflection coils are supported by a synthetic material support, and said flux collector members are integral with such synthetic material support.

* * * * *